US005639032A

United States Patent [19]

Roessler

[11] Patent Number: 5,639,032

[45] Date of Patent: Jun. 17, 1997

[54] COMMINUTING UNIT

[75] Inventor: Peter Roessler, Ilsfeld, Germany

[73] Assignee: Weima Apparatebau GmbH, Ilsfeld, Germany

[21] Appl. No.: 633,820

[22] PCT Filed: Sep. 24, 1994

[86] PCT No.: PCT/EP94/03189

§ 371 Date: Jul. 18, 1996

§ 102(e) Date: Jul. 18, 1996

[87] PCT Pub. No.: WO95/11084

PCT Pub. Date: Apr. 27, 1995

[30] Foreign Application Priority Data

Oct. 22, 1993 [DE] Germany ..... 9316152 U

[51] Int. Cl.[6] ..... B02C 18/06; B02C 18/40; B02C 25/00

[52] U.S. Cl. ..... 241/33; 241/34; 241/36; 241/37.5; 241/243

[58] Field of Search ..... 241/33, 34, 36, 241/37.5, 243, DIG. 38

[56] References Cited

U.S. PATENT DOCUMENTS

| | | | |
|---|---|---|---|
| 4,043,514 | 8/1977 | Peterson, Jr. | 241/36 |
| 4,200,243 | 4/1980 | Peterson, Jr. | 241/224 |
| 4,844,363 | 7/1989 | Garnier et al. | 241/224 |
| 5,035,367 | 7/1991 | Nojima | 241/37.5 |
| 5,205,495 | 4/1993 | Garnier | 241/31 |

FOREIGN PATENT DOCUMENTS

| | | |
|---|---|---|
| 0514327 | 11/1992 | European Pat. Off. . |
| 2465523 | 3/1981 | France . |
| 2441675 | 3/1976 | Germany . |
| 9003477 U | 7/1991 | Germany . |
| 429396 | 7/1967 | Switzerland . |

*Primary Examiner*—John M. Husar
*Attorney, Agent, or Firm*—Dinsmore & Shohl LLP

[57] ABSTRACT

A pulverizing mill designed especially for waste products made of plastic is equipped with a pulverizing cylinder (14) situated under a downward slanted cover plate (22) by means of which the connection between the pulverizing cylinder (14) and a hopper (52) containing the material to be pulverized can be alteratively opened and closed. When the pulverizing mill is switched off, a control unit (70) continues to energize a cylinder drive (68) until the cover plate has been moved into its closed position. This ensures that the pulverizing cylinder (14) can be restarted, even though the cylinder drive (68) is set to run the pulverizing cylinder at high speeds of preferably 200 to 1000 rpm, as is advantageous for plastic waste products.

7 Claims, 1 Drawing Sheet

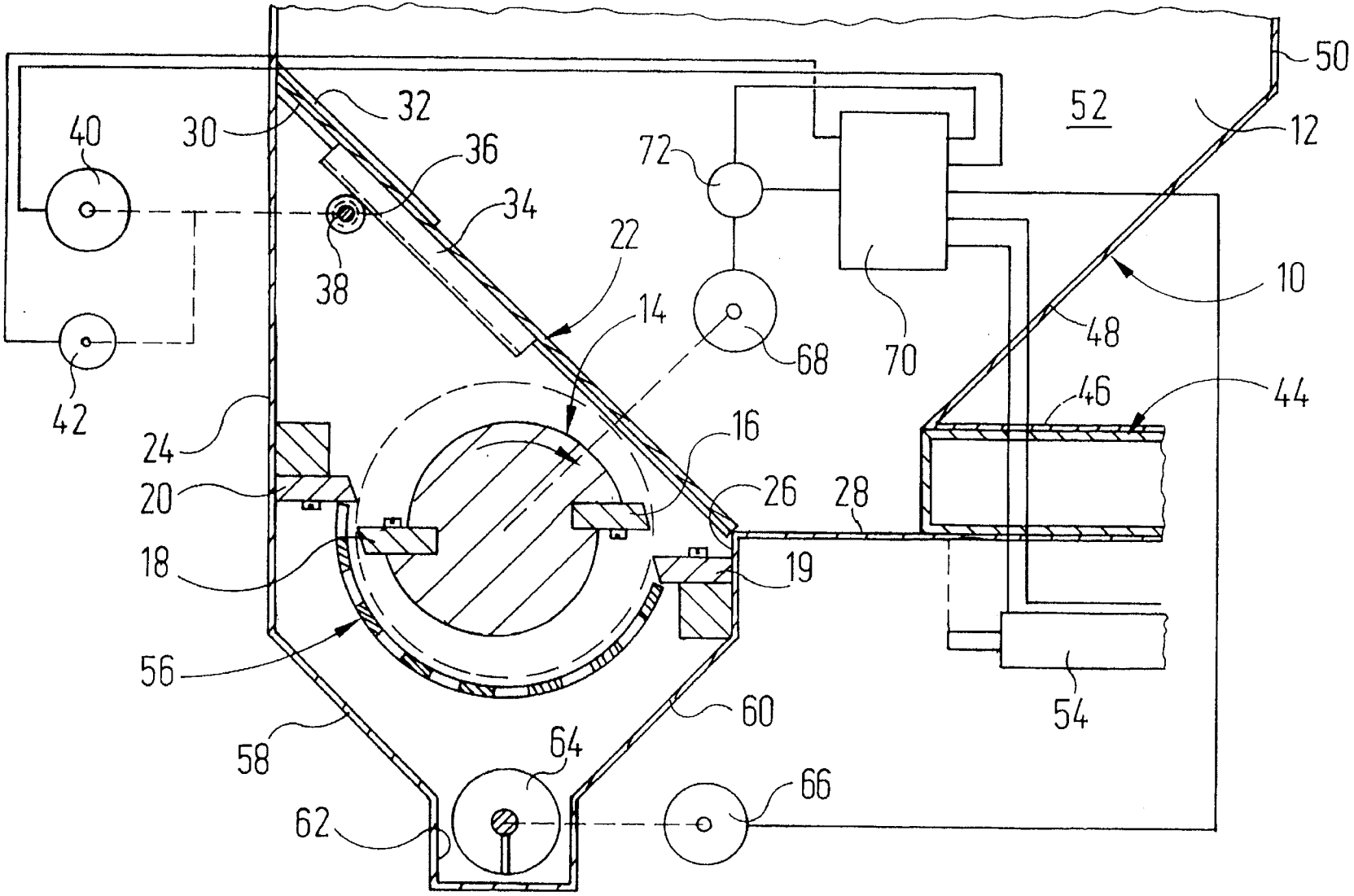
50
12
10
44
52
48
46
54
70
28
68
26
19
66
16
60
72
14
22
64
34
36
32
38
62
30
58
24
20
18
56
40
42

COMMINUTING UNIT

The invention relates to a comminuting unit.

Comminuting units of this kind, such as are described in DE 90 03 477 U for example are widely used in practice for comminuting waste timber. In them the comminuting cylinder is driven by the cylinder drive at typically 80 rpm via a stepdown gear. These comminuting tools are distinguished by good uniformity of the comminuted material and low noise emission. They have only limited suitability for use with plastics waste materials, however.

The object of the invention is to develop a comminuting unit in such a way that it is also suitable for use with plastics waste and other tough waste materials.

This object is achieved by a comminuting unit according to the invention by means of The comminuting unit according to the invention operates at a rotational speed of the comminuting cylinder of the order of 200 to 1000 rpm, which is high compared with the known comminuting units. With a design of the cylinder drive of this kind the comminuting cylinder, whose knife bodies are in practice long strips which cooperate with counter-knives which are also strip-shaped, would not start if only one fairly large piece of waste had moved between a knife body and a counter-knife if the comminuting cylinder was slowly running down after the machine had been switched off. Such operating conditions are avoided in the comminuting unit according to the invention since a cover plate is provided above the comminuting cylinder, which cover plate is initially moved positively by the control unit of the comminuting unit into a closed position which covers the comminuting cylinder completely with respect to the hopper for the material to be comminuted before the comminuting cylinder comes to a stop.

With the development of the invention the loads of the comminuting cylinder are substantially kept constant including in continuous operation.

In a comminuting unit of the invention, those parts of the cover plate which are located above the comminuting cylinder form a sliding surface leading to the knife engagement region.

The development of the invention is of advantage in respect of a tilt-free and hence jam-free movement of cover plates, including ones with large lateral dimensions, under the load of material to be comminuted resting thereon.

With the development of the invention a particularly favourable feed of the material to be comminuted to the first knife engagement region is guaranteed.

The invention is described below with the aid of an embodiment, with reference to the drawing.

The single illustration shows a diagrammatic vertical longitudinal central section through a comminuting unit particularly suitable for plastics waste, in which different drives and an associated control unit are also shown in diagrammatic form.

The comminuting unit shown in the drawing has a housing, denoted overall by 10, which is welded together from thick, suitably edged steel sheet components.

A comminuting cylinder denoted overall by 14 is mounted on side walls 12 of the housing by means of bearings which are not shown. This cylinder has strip-shaped knife bodies 16, 18 which cooperate with counter-knives 19, 20 which are also strip-shaped and are fixed to the housing.

Above the comminuting cylinder 14 a cover plate 22 is guided on a path on the housing 10 which leads from an end wall 24 of the housing on the left-hand side of the drawing over the comminuting cylinder 14 at a downwards slant to a step 26 in a base wall 28 of the housing.

Lower guide strips 30 provided at its lateral edges and upper guide strips 32 which are permanently welded to the side walls 12 provide the guide of the cover plate 22.

At its lateral edges in each case the underside of the cover plate 22 carries a toothed rack 34 with which a pinion 36 engages. The two pinions 36 are rigidly coupled by means of a shaft 38 on which a cover drive 40 engages. The instantaneous position of the cover plate 22 is determined by a position sensor 42 which is also mechanically coupled to the shaft 38. In its place, several limit switches distributed along the path of the cover plate 22 can also be used.

A feed slide 44, which is formed as a hollow box section, is movable above the base wall 28. Its upper side cooperates with a protective wall 46 which is connected to a wall 48 of the housing which is opposite the cover plate 40 and inclined similarly but in the opposite direction. The lateral walls of the feed slide 44 run in front of the side walls 12 with small clearance.

An end wall 50 of the housing 10 adjoining the upper end of the wall 48 forms the last part of the enclosure of a hopper 52 into which the material to be comminuted is introduced.

The drawing shows the feed slide in a fully retracted rest position in which it stands completely under the protective wall 46. A hydraulic double-action working cylinder B4 with corresponding stroke is provided to move the feed slide 44 towards the comminuting cylinder 14 (and back into the rest position).

A partially cylindrical perforated screen 56, which lies outside the path of the tips of the knife bodies 16, 18 which is shown in dotted lines, is arranged between the counter-knives 19, 20. Downward slanting lower hopper walls 58, 60 guide the chips falling through the perforated screen 56 downwards to a collecting channel 62 in which a worm conveyor 64 operates. A worm drive 66 is allocated to it.

A cylinder drive 68, which is energized from a central control unit 70 of the comminuting unit as are the cover drive 40, the working cylinder 54 and the worm drive 66, is provided to rotate the comminuting cylinder 14. The control unit 70 operates according to the output signal of the position sensor 42 and a power meter 72, which is switched in the supply line of the cylinder drive 68.

The control unit 70 operates according to the following criteria:

a) If the operator requests a switching-off of the comminuting unit, first of all the cover drive 40 is energized in the closure direction of the cover plate 22. The cylinder drive 68 continues to be energized until the cover plate 22 has reached its full closed position shown in the drawing. Only then is the cylinder drive 68 switched off.

b) If the comminuting unit is switched on, the cover plate initially remains in its closed position until the comminuting cylinder has reached a pre-set minimum speed. Only then is the cover plate made to open.

c) Whenever the load of the comminuting cylinder 14 measured by the output signal of the power meter 72 exceeds a preset threshold value the cover plate 22 is moved into the closed position. This can take place either stepwise or continuously in the form of a re-adjustment.

d) The working cylinder 54 is only energized in the direction of an extension of the feed slide 44 if the cover plate 22 has already been at least partially opened.

e) The pressure fluid supply of the working cylinder 54 is interrupted or switched over in the direction of a retraction of the piston rod of the working cylinder 54 if too high a power input of the cylinder drive 68 is monitored.

f) The cover drive 40 is energized in the direction of a closure of the cover plate 22 when the measured power input of the cylinder drive 68 exceeds a pre-set threshold.

g) The cover drive 40 is energized in the direction of an enlargement of the opening between the free edge of the cover plate 22 and the shoulder of the base wall 28 if the measured power of the cylinder drive 68 is below a pre-set threshold.

h) The working cylinder 54 is energized in the direction of an extension of the feed slide 44 if the measured power of the cylinder drive 68 is below a pre-set threshold.

Where reference is made to threshold values in the above points a) to h), this is understood to mean that these are characteristic of the point in question and do not need to coincide.

I claim:

1. A comminuting unit with a housing (10), with a comminuting cylinder (14) equipped with knife bodies (16, 18) and mounted in the housing (10), with counter-knives (19, 20) fixed to the housing, with a screen (56) surrounding the comminuting cylinder (14) partially at a distance, with a hopper (52) of the housing (10) lying above the engagement region of knife bodies (16, 18) and counter-knives (19, 20), with a feed slide (44) movable to and fro above a base wall (28) of the housing (10) and with a cylinder drive (68) and a slide drive (54), wherein the cylinder drive (68) drives the comminuting cylinder (14) at a high speed range of 200 to 1000 rpm; wherein a cover plate (22) movable by means of a cover drive (40) is arranged above the comminuting cylinder (14), which cover plate can be displaced between a closed position in which it covers the comminuting cylinder (14) with respect to the hopper (52), and at least one release position in which the connection between the comminuting cylinder (14) and the hopper (52) is at least partially released; and wherein a control unit (70) for the cylinder drive (68) and the cover drive (40) operates according to the load (72) of the comminuting cylinder (14) in such a way that the cylinder drive (68) is only switched off when the cover plate (22) has already reached its closed position, and the cover plate (22) is only moved into its release position when the comminuting cylinder (14) has reached a pre-set minimum speed.

2. A comminuting unit as claimed in claim 1, wherein the control unit (70) also controls the slide drive (54) in such a way that it is stopped or energized in the retraction direction when the load (72) of the comminuting cylinder (14) exceeds a pre-set threshold value, and is energized in the extension direction when the cover plate (22) is in a release position and the load (72) of the comminuting cylinder (14) is below a pre-set value.

3. A comminuting unit as claimed in claim 2, wherein the control unit (70) energizes the slide drive (54) in such a way that the load of the comminuting cylinder (14) is substantially constant.

4. A comminuting unit as claimed in one of claims 1 to 3, wherein the control unit (70) energizes the cover drive (40) in such a way that the load of the comminuting cylinder (14) is substantially constant.

5. A comminuting unit as claimed in one of claims 1 to 3, wherein the cover plate (22) is guided on a path slanting downward to the knife engagement region (30, 32).

6. A comminuting unit as claimed in one of claims 1 to 3, wherein the cover drive (40) operates on two rigidly coupled drive elements (34, 36) allocated to the lateral edges of the cover plate (22).

7. A comminuting unit as claimed in one of claims 1 to 3, wherein a counter-knife (19) adjacent to the base wall (28) of the hopper (52) is arranged offset downwards with respect to the base wall (28).

* * * * *